US011391288B2

(12) United States Patent
Miller et al.

(10) Patent No.: US 11,391,288 B2
(45) Date of Patent: Jul. 19, 2022

(54) SYSTEM AND METHOD FOR OPERATING A COMPRESSOR ASSEMBLY

(71) Applicant: General Electric Company, Schenectady, NY (US)

(72) Inventors: Kyle Louis Miller, Cincinnati, OH (US); Andrew Breeze-Stringfellow, Montgomery, OH (US)

(73) Assignee: General Electric Company, Schenectady, NY (US)

( * ) Notice: Subject to any disclaimer, the term of this patent is extended or adjusted under 35 U.S.C. 154(b) by 129 days.

(21) Appl. No.: 17/015,400

(22) Filed: Sep. 9, 2020

(65) Prior Publication Data

US 2022/0074420 A1 Mar. 10, 2022

(51) Int. Cl.
*F04D 27/00* (2006.01)
*F04D 27/02* (2006.01)

(52) U.S. Cl.
CPC ..... *F04D 27/001* (2013.01); *F04D 27/02* (2013.01); *F05B 2220/302* (2013.01); *F05B 2270/301* (2013.01); *F05D 2270/101* (2013.01)

(58) Field of Classification Search
CPC .. F04D 27/001; F04D 27/02; F05B 2220/302; F05B 2270/101; F05D 2270/101
See application file for complete search history.

(56) References Cited

U.S. PATENT DOCUMENTS 6,010,303 A 1/2000 Feulner
6,438,484 B1 8/2002 Andrew et al.
6,506,010 B1 1/2003 Yeung et al.
6,532,433 B2 3/2003 Bharadwaj et al.
6,793,455 B2 9/2004 Prasad et al.
6,823,675 B2 11/2004 Brunell et al.
7,356,999 B2 4/2008 Bodell, II et al.
8,550,767 B2 10/2013 Hom et al.
8,661,832 B2 3/2014 Griffin et al.
2017/0102694 A1* 4/2017 Enver ..... G05B 19/4184
2017/0103103 A1* 4/2017 Nixon ..... G06F 16/256
2017/0175646 A1 6/2017 Adibhatla
2020/0103894 A1* 4/2020 Celia ..... G05B 19/41865
2020/0133257 A1* 4/2020 Celia ..... H04B 17/318

OTHER PUBLICATIONS

Dhingra et al, A Stochastic Model for a Compressor Stability Measure, GT2006-91182, The American Society of Mechanical Engineers, ASME Turbo Expo 2006: Power for Land, Sea, and Air, Barcelona, Spain, May 8-11, 2006. (Abstract Only).

* cited by examiner

*Primary Examiner* — Igor Kershteyn
(74) *Attorney, Agent, or Firm* — Fitch, Even, Tabin & Flannery LLP

(57) ABSTRACT

A turbo machine, a computer-implemented method, and a computer system for operating a compressor assembly are provided. The method includes comparing a first data set and a second data set to determine a first correlation factor, comparing the first correlation factor to a first threshold that at least partially determines whether a stall precursor exists, removing mean values from the first data set and the second data set, comparing the first data set and the second data set each removed of mean values to determine a second correlation factor, and comparing the second correlation factor to the first threshold, and classifying the stall precursor as either a spike stall precursor, a modal stall precursor, or a combination stall precursor.

20 Claims, 10 Drawing Sheets

SYSTEM AND METHOD FOR OPERATING A COMPRESSOR ASSEMBLY

FEDERALLY SPONSORED RESEARCH

This invention was made with government support under contract number DTFAWA-10-C-00046 under the Federal Aviation Administration of the U.S. Government. The government may have certain rights in the invention.

FIELD

The present subject matter relates generally to methods and systems for operating a compressor assembly to avoid surge or stall at a turbo machine.

BACKGROUND

Compressor assemblies included in turbo machines may undergo surge or stall based on a plurality of factors. Compressor stall includes a local disruption in airflow through the compressor assembly. Compressor stall may include rotating stall, in which a portion of airfoils of a compressor assembly experience flow destabilization or stagnation (e.g., stall cells). For instance, compressor stall may include rotating stall cells in which relatively stagnant air rotates from airfoil to airfoil within a compressor stage rather than along the desired flow direction (e.g., along the axial direction of an axial compressor).

Axisymmetric stall or compressor surge includes flow oscillations or reverse airflows (i.e., flows opposite of the desired flow direction). Compressor surge may include an undesired expulsion of compressed air through a compressor inlet rather than a compressor outlet. Compressor surge may result from an inability of the compressor assembly to continue to pressurize or add work to compressed air. The limits of operation of a compressor assembly may be defined by a surge line (e.g., pressure ratio versus flow rate). During operation, as compressor assemblies become more highly loaded, disturbances in flow that may initialize as rotating stall may develop into compressor surge in less than one second. Furthermore, as a turbo machine operates over time and various conditions, wear and deterioration may reduce operability or performance of a compressor assembly, such as to make the compressor assembly more susceptible to compressor stall or surge.

Compressor stall or surge may result in damage of the compressor assembly and the turbo machine. Although various mechanisms are known for avoiding compressor stall or surge conditions, a known problem is detecting an upcoming surge or stall condition before the turbo machine surges or stalls, such as to perform maneuvers to avoid the condition. Additionally, a known problem is detecting the type of stall or surge condition to which the compressor assembly is approaching, as the type of surge or stall condition will at least in part be determinative of what changes in engine maneuvers are necessitated based on the specific type of surge or stall different from one another. Without detecting an upcoming stall or surge, or without detecting the type of upcoming stall or surge, turbo machine operators may be unable to avoid encountering compressor stalls or surges that may deteriorate the life of the turbo machine or result in uncommanded engine shutdowns, sudden losses in thrust, or overall damage to the turbo machine. Furthermore, without detecting the type of upcoming stall or surge, turbo machine operators may apply surge or stall mitigation maneuvers to little or no effect to avoid the specific type of surge or stall encountered.

BRIEF DESCRIPTION

Aspects and advantages of the invention will be set forth in part in the following description, or may be obvious from the description, or may be learned through practice of the invention.

An aspect of the present disclosure is directed to a computer-implemented method for operating a compressor assembly. The method includes obtaining a first data set over a first period of time; obtaining a second data set over a second period of time after the first period of time; comparing the first data set and the second data set to determine a first correlation factor; comparing the first correlation factor to a first threshold, wherein the first threshold at least partially determines whether a stall precursor exists; removing mean values from the first data set and the second data set; comparing the first data set and the second data set each removed of mean values to determine a second correlation factor; comparing the second correlation factor to the first threshold, wherein comparing the second correlation factor to the first threshold at least partially determines whether the stall precursor comprises one of a spike stall precursor, a modal stall precursor, or a combination stall precursor; and classifying the stall precursor as either the spike stall precursor, the modal stall precursor, or the combination stall precursor.

Another aspect of the present disclosure is directed to a computing system for operating a turbo machine. The computing system is configured to perform operations, such as via a controller including a processor and memory configured to store instructions that, when executed by the processor, causes the processor to perform operations. The operations include obtaining a first data set over a first period of time; obtaining a second data set over a second period of time after the first period of time, wherein the second period of time is during a revolution of the turbo machine after obtaining the first data set over the first period of time; identifying whether a stall precursor exists at the turbo machine; and identifying a type of stall precursor, wherein the type of stall precursor comprises one of a spike stall precursor, a modal stall precursor, or a combination stall precursor. Identifying the type of stall precursor includes comparing the first data set and the second data set to provide a first correlation factor; removing mean values from the first data set and the second data set; determining a second correlation factor by comparing the first data set and the second data set each removed of mean values; and comparing the second correlation factor to a first threshold; and generating a control signal based at least on the identified type of stall precursor.

Yet another aspect of the present disclosure is directed to a turbo machine including a compressor assembly. The compressor assembly includes a sensor positioned at adjacent stages of compressor blade rows. The sensor is configured to obtain a performance parameter of a fluid through the compressor assembly. The turbo machine further includes a controller including a processor and memory configured to store instructions that, when executed by the processor, causes the processor to perform operations. The operations include obtaining, via the sensor, a first data set over a first period of time during rotation of the compressor assembly; obtaining, via the sensor, a second data set over a second period of time following the first period of time, wherein the second period of time corresponds to one or more revolutions of the compressor assembly after the first period of time; comparing the first data set and the second data set to determine a first correlation factor; removing mean values of the first data set and the second data set; determining a second correlation factor by comparing the first data set and the second data set each removed of mean values; determining a type of stall precursor at the compressor assembly, wherein determining the type of stall precursor is based at least on comparing the first correlation factor to a first threshold and comparing the second correlation factor to a magnitude threshold, and wherein the type of stall precursor is one of a spike stall precursor, a modal stall precursor, or a combination stall precursor; and operating the compressor assembly based at least on the determined type of stall precursor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
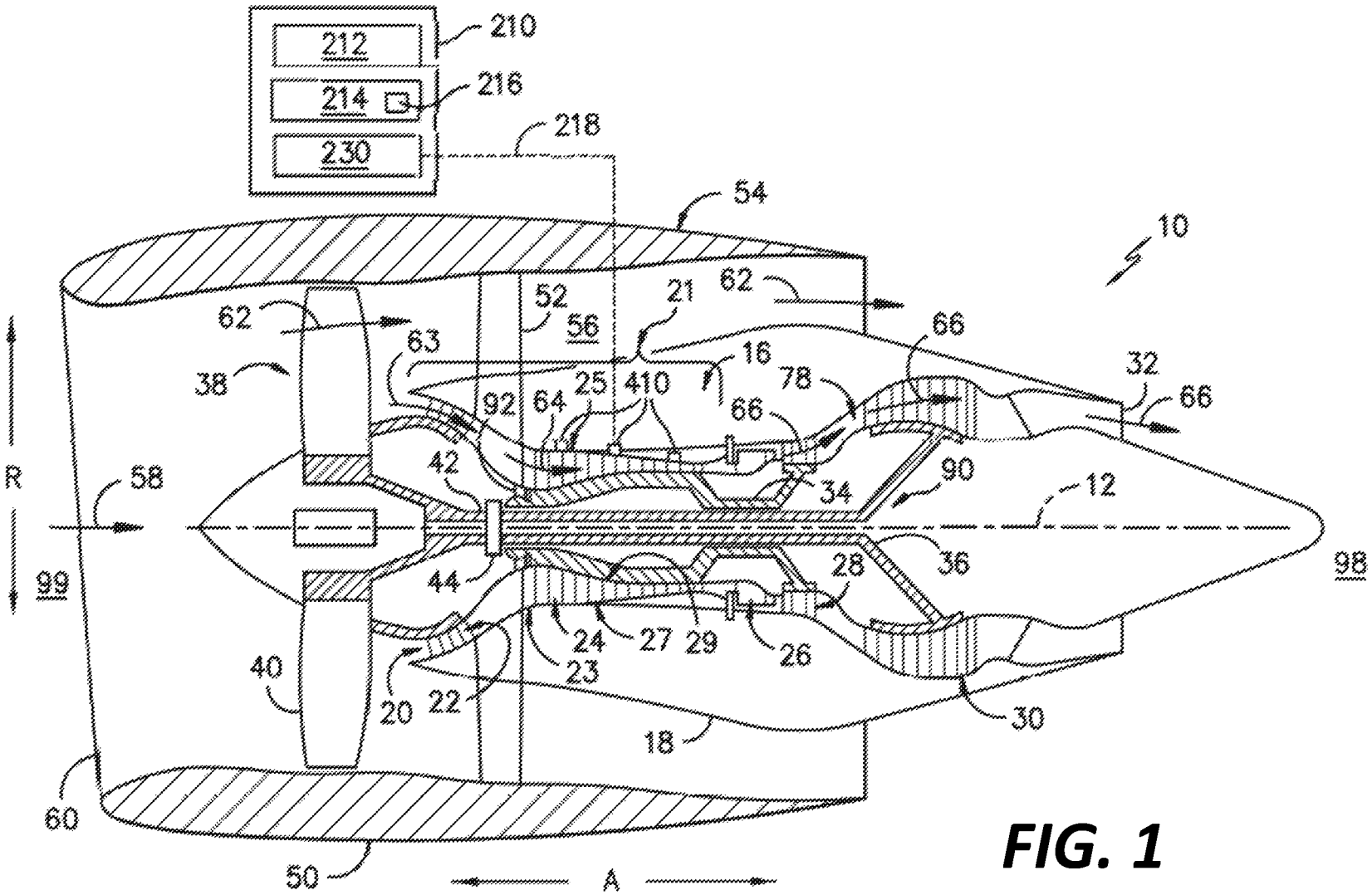
FIG. 1 is an exemplary turbo machine including a controller configured to perform operations shown and described according to aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway during normal or desired turbo machine or compressor assembly operation (e.g., without aerodynamic stall or surge). For example, "upstream" refers to the direction from which the fluid flows (e.g., from a forward end), and "downstream" refers to the direction to which the fluid flows (e.g., toward an aft end). It should be appreciated that although embodiments of the apparatus and methods shown and described herein may depict an axial flow compressor, embodiments of the turbo machine, compressor assembly, and/or methods provided herein may be applied to centrifugal compressors, reverse-flow turbo machines, or other applicable compressor or turbo machine configurations.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a method and system for operating a compressor assembly and turbo machine are generally provided. The methods and systems provided herein determine whether the compressor assembly and turbo machine is operating with a stall precursor. The methods and systems further identify or classify whether the stall precursor is a spike stall precursor, a modal stall precursor, or a combination stall precursor that includes spike stall and modal stall precursors. The spike stall precursor is indicative of the compressor assembly operating at or toward, but prior to, a spike stall condition. The modal stall precursor is indicative of the compressor assembly operating at or toward, but prior to, a modal stall condition. The combination stall precursor is indicative of the compressor assembly operating at or toward, a stall condition including both spike stall and modal stall. Various embodiments of the methods and systems provided herein further generating one or more control signals, control responses, or operations at the compressor assembly or turbo machine based at least on the determined stall precursor.

It should be appreciated that spike stalls, modal stalls, or combination stalls generally form differently at the compressor assembly. Modal stalls generally arise from relatively small amplitude airflow or pressure disturbances (e.g., relative to mean velocity of airflow), such as around a circumferential distance of a compressor at one or more rotating stages. Spike stalls generally arise from relatively large amplitude airflow or pressure disturbances, such as along relatively shorter circumferential distances of the compressor (e.g., along a portion of compressor blades). Spike stalls may generally define sharp pressure or velocity waveforms or spikes over time or rotor revolution in contrast to modal stalls.

Furthermore, spike stalls may generally form at, from, or proximate to a blade tip of a rotor assembly. Modal stalls may generally form at, from, or proximate to a blade root or hub of the rotor assembly (e.g., depicted at arrow 29 in FIG.

1). Differences in formation of the stall may at least in part determine what operations or manoeuvres are performed to remove the stall condition or mitigate exasperation of the stall condition (e.g., mitigate development of compressor surge). The methods and systems provided herein may further include adjusting compressor loading or a rate of acceleration based at least on whether the compressor assembly and turbo machine include a spike stall precursor, a modal stall precursor, or a combination stall precursor.

It should be appreciated that, in various embodiments, operating the turbo machine is based specifically on the determined stall precursor such as to avoid formation of compressor stall or surge. Whether the turbo machine is approaching stall or surge based on the spike stall condition may necessitate adjustment in the operating mode of the turbo machine different from adjustment in operating mode when the turbo machine is approaching stall or surge based on conditions not including the spike stall condition. It should further be appreciated that, without determining specifically the spike stall condition or the modal oscillation condition, adjustments in operation of the turbo machine may fail to prevent stall or surge, as adjustments based on the spike stall precursor may be separate or different from adjustments based on the modal stall precursor. Additionally, or alternatively, adjustments based on the spike stall condition do not necessarily prevent stall or surge in contrast to adjustments based on the modal oscillation condition. Still further, methods or operations that may adjust for both modal and spike stall generally (i.e., not specific to one or the other of modal stall or spike stall) may undesirably reduce compressor or turbo machine operability or performance. Such reductions may lead to undesired additions or complications to the compressor assembly or turbo machine, thereby reducing performance, operability, or efficiency of the overall system.

As such, embodiments of the method and system provided herein beneficially determine whether the compressor assembly and turbo machine is operating toward a spike stall, a modal stall, or a combination stall condition. Operation of the compressor assembly and turbo machine, or adjustments thereto, may be performed to avoid stall or surge based on the determined stall precursor. Such determination may improve turbo machine operability, performance, efficiency, and durability. Furthermore, embodiments of the method and system provided herein may be implemented with existing turbo machines, such as via upgrades in software, computing device, controllers, etc., such as to improve compressor assembly performance or operability in existing turbo machines.

It should be appreciated that reference herein to only one of spike stall or spike stall precursor, or modal stall or modal stall precursor, refers to a magnitude or presence great enough such that the presence of the other of the stall conditions or precursors may be considered negligible. However, reference to a combination stall precursor refers to a magnitude or presence of both the spike stall precursors and the modal stall precursors such as to be considered non-negligible or considerable in regard to operation, or adjustments thereto, to compressor assembly or turbo machine operation.

Referring now to the figures, FIG. 1 provides a schematic partially cross-sectioned side view of an exemplary turbo machine 10 herein referred to as "engine 10" as may incorporate various embodiments of the present invention. Various embodiments of the engine 10 may define a turbofan, turboshaft, turboprop, or turbojet gas turbine engine, including marine and industrial engines and auxiliary power units, or steam turbine engines, open rotor engines, or other apparatuses including compressor assemblies. As shown in FIG. 1, the engine 10 has a longitudinal or axial centerline axis 12 that extends therethrough for reference purposes. An axial direction A is extended co-directional to the axial centerline axis 12 for reference. A radial direction R is extended perpendicular to the centerline axis 12. The engine 10 further defines an upstream end 99 and a downstream end 98 for reference. In general, the engine 10 may include a fan assembly 38 and a core engine 16 disposed downstream from the fan assembly 38.

Figure 2:
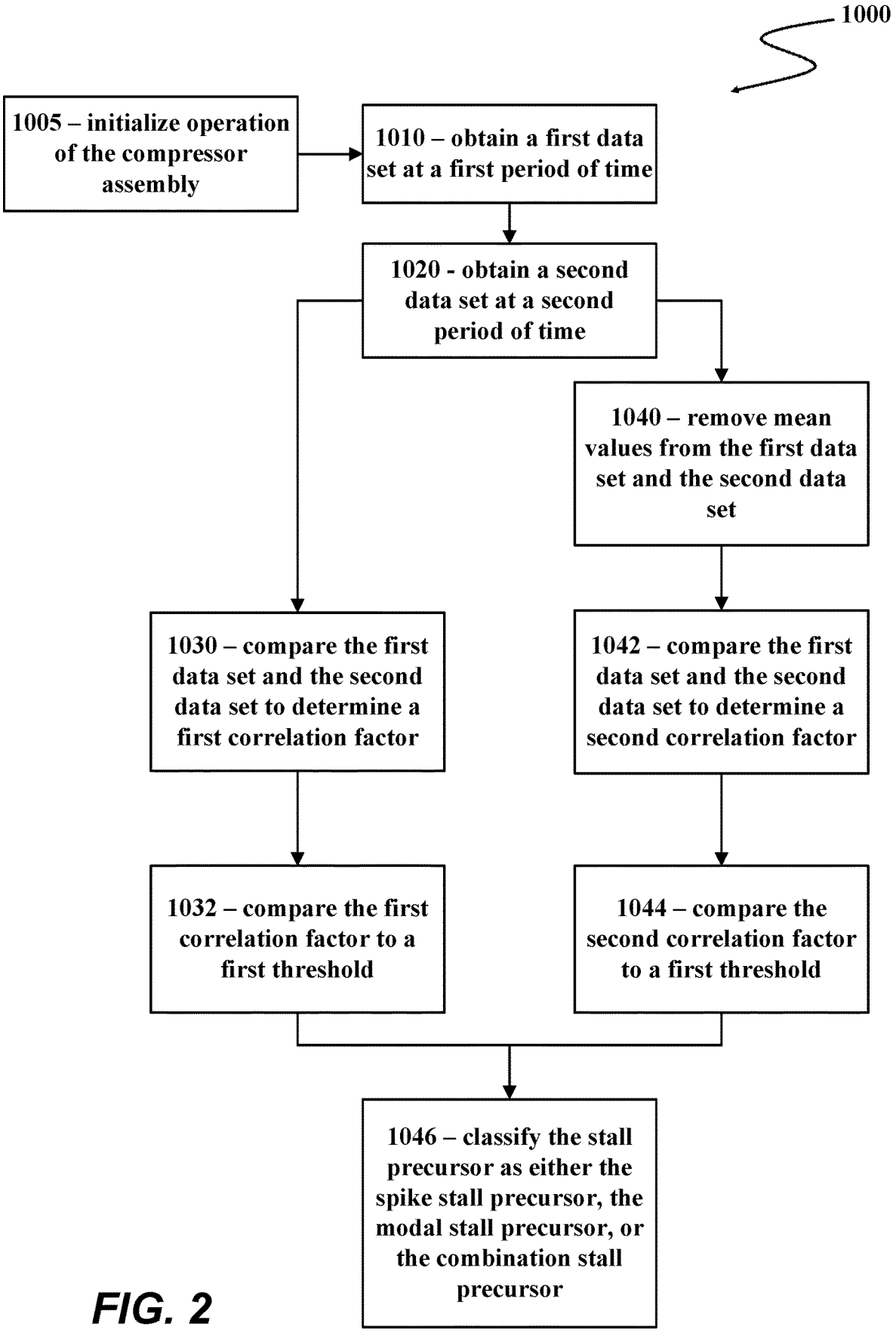
FIGS. 2-4 are flow charts outlining exemplary steps of methods for operating a compressor assembly.
Figure 3:
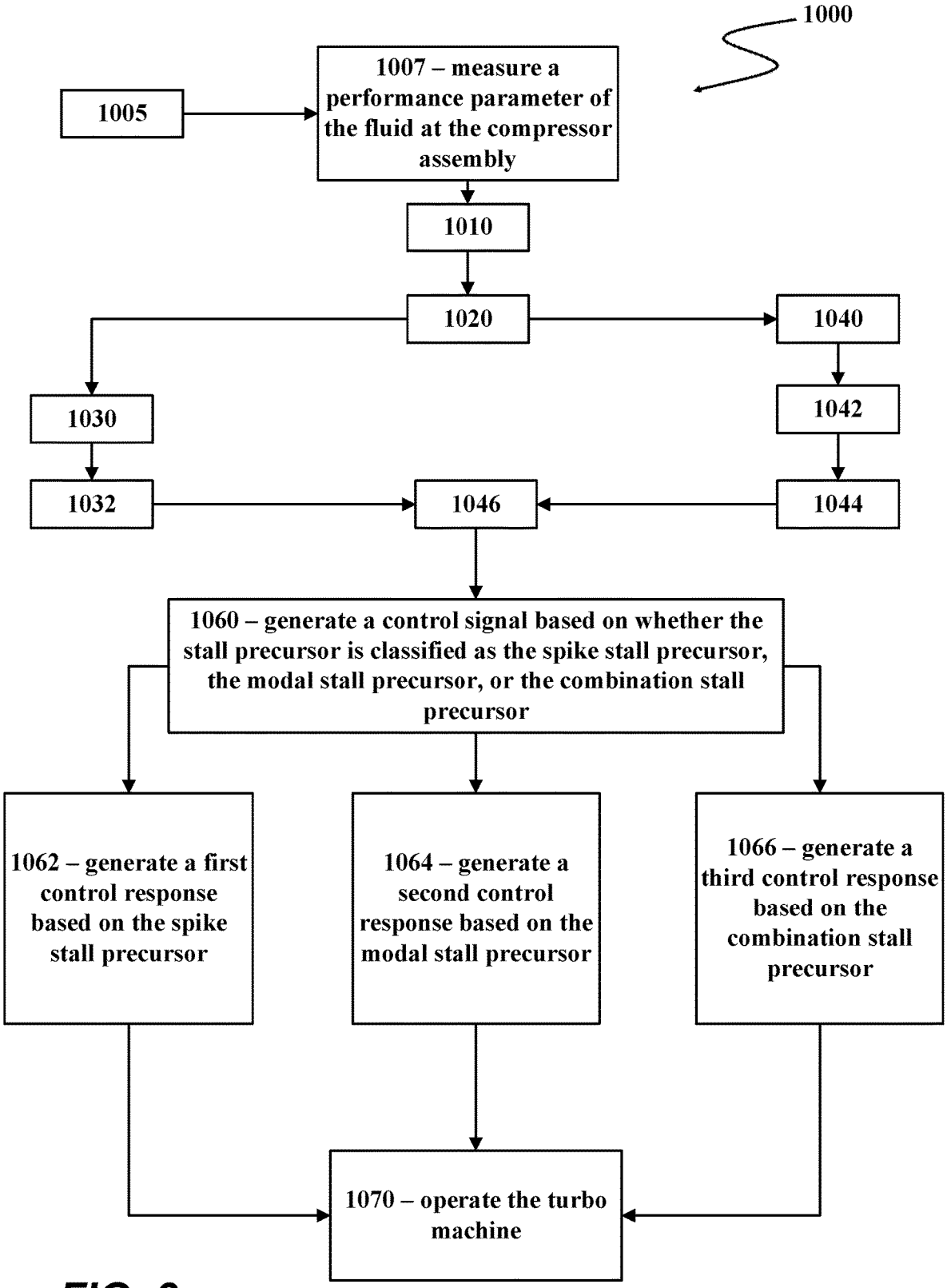
Figure 4:
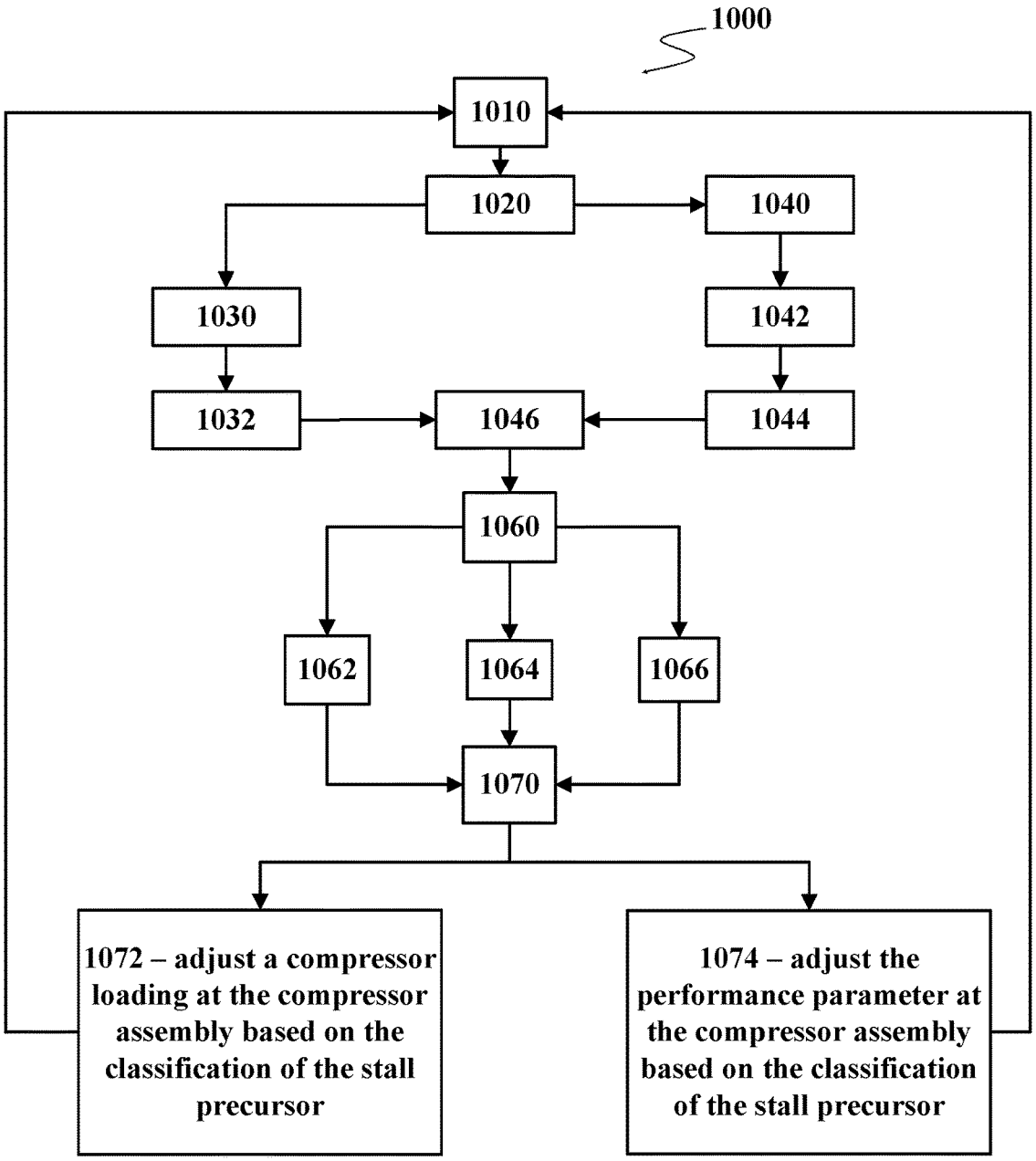

The core engine 16 may generally include a substantially tubular outer casing 18 that defines a core inlet 20 to a core flowpath 78. The outer casing 18 encases or at least partially forms the core engine 16. The outer casing 18 encases or at least partially forms, in serial flow relationship, a booster or low pressure (LP) compressor 22, a high pressure (HP) compressor 24, a combustion section 26, a turbine section 31 including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 42 of the fan assembly 38. In particular embodiments, as shown in FIGS. 2-4, the LP rotor shaft 36 may be connected to the fan shaft 42 via a reduction gear 44 such as in an indirect-drive or geared-drive configuration.

As shown in FIG. 1, the fan assembly 38 includes a plurality of fan blades 40 that are coupled to and that extend radially outwardly from the fan shaft 42. In certain embodiments, the fan assembly 38 includes one or more rows or stages of fan blades 40 longitudinally spaced apart from one another. An annular fan casing or nacelle 54 circumferentially surrounds the fan assembly 38 and/or at least a portion of the core engine 16. It should be appreciated by those of ordinary skill in the art that the nacelle 54 may be configured to be supported relative to the core engine 16 by a plurality of circumferentially-spaced outlet guide vanes or struts 52. Moreover, at least a portion of the nacelle 54 may extend over an outer portion of the core engine 16 so as to define a bypass airflow passage 56 therebetween. However, it should be appreciated that other embodiments of the engine 10 may define an open rotor assembly, in which one or more stages of the fan blades 40 are unshrouded by a nacelle. Certain embodiments of the engine 10 may partially or completely remove the nacelle.

It should be appreciated that combinations of the shaft 34, 36, 42, the compressors 22, 24, 38 and the turbines 28, 30 define a rotor assembly 90 of the engine 10. For example, the HP shaft 34, HP compressor 24, and HP turbine 28 may define an HP rotor assembly of the engine 10. Similarly, combinations of the LP shaft 36, LP compressor 22, and LP turbine 30 may define an LP rotor assembly of the engine 10. Various embodiments of the engine 10 may furthermore, or alternatively, include the fan shaft 42 and fan blades 40 as the LP rotor assembly. In other embodiments, the engine 10 may further define a fan rotor assembly at least partially mechanically de-coupled from the LP spool via the fan shaft 42 and the reduction gear 44. Still other embodiments may further include one or more intermediate rotor assemblies defined by an intermediate pressure compressor, an intermediate pressure shaft, and an intermediate pressure turbine disposed between the LP rotor assembly and the HP rotor assembly relative to serial aerodynamic flow arrangement during normal operation.

It should be appreciated that, as used herein, various embodiments of a method for operating a compressor assembly (hereinafter, "method 1000"), a computer-implemented system for executing steps of the method 100 (hereinafter, "system 400"), the engine 10, and/or a controller 210 shown and described herein may refer to the compressor assembly 21 as including one or more of a fan assembly (e.g., fan assembly 38) or one or more compressors (e.g., the LP compressor 22, the HP compressor 24, or one or more intermediate pressure compressors positioned between the LP compressor and the HP compressor), or combination thereof. Furthermore, it should be appreciated that embodiments of the method 1000, the system 400, or the controller 210 may be applicable to standalone compressor assemblies unattached to a combustor or turbine assembly. For instance, the compressor assembly may be driven by an external drive mechanism, load device, motor, or other motive device.

Various embodiments of the engine 10 may further include a mechanical load device or electric machine 92 electrically coupled to one or more rotor assemblies 90, such as to generate, store, and/or distribute energy at the mechanical load device or electric machine 92 from and/or to the rotor assembly 90. For example, the mechanical load device or electric machine 92 may be configured to extract energy from operation of the rotor assembly 90 such as to provide electrical energy to electrical systems of the engine 10 (e.g., the controller 210 further described herein), or aircraft or other apparatuses and sub-systems attached thereto. As yet another example, the mechanical load device or electric machine 92 may be configured drive the rotor assembly 90, or particularly the compressor assembly 21, to increase or decrease loading at the rotor assembly 90 such as to allow increased or decreased acceleration at the rotor assembly 90, or particularly at the compressor assembly 21, based at least on desired compressor loading, or changes therein, based on the method 1000 described herein for operating a compressor assembly to avoid spike stall and/or modal oscillations.

During operation of the engine 10, a flow of air, shown schematically by arrows 58, enters an inlet 60 of the engine 10 defined by the fan case or nacelle 54. A portion of air, shown schematically by arrows 63, enters the flowpath 78 at the core engine 16 through the core inlet 20 defined at least partially via the casing 18. The flow of air 63 is increasingly compressed as it flows across successive stages of the compressors 22, 24, such as shown schematically by arrows 64. The compressed air 64 enters the combustion section 26 and mixes with a liquid or gaseous fuel and is ignited to produce combustion gases 66. The combustion gases 66 release energy to drive rotation of the HP rotor assembly and the LP rotor assembly before exhausting from the jet exhaust nozzle section 32. The release of energy from the combustion gases 66 further drives rotation of the fan assembly 38, including the fan blades 40. A portion of the air 62 bypasses the core engine 16 and flows across the bypass airflow passage 56, such as shown schematically by arrows 62.

Referring to FIG. 1, the engine 10 may further include a controller 210 configured to execute steps of the method 1000. In certain embodiments, the controller 210 includes, at least in part, the system 400 further depicted and described herein. In various embodiments, the controller 210 can generally correspond to any suitable processor-based device, including one or more computing devices. For instance, FIG. 1 illustrates one embodiment of suitable components that can be included within the controller 210. As shown in FIG. 1, the controller 210 can include a processor 212 and associated memory 214 configured to perform a variety of computer-implemented functions. In various embodiments, the controller 210 may be configured to operate the engine 10 such as to determine an operating condition of the engine 10 corresponding to whether the compressor assembly 21 is operating in or toward a spike stall condition or a modal oscillation condition, such as further described herein. The controller 210 may further be configured to generate and transmit a control signal 218 corresponding to the determined operating condition. The controller 210 may still further be configured to operate the engine 10 based at least on the control signal 418, such as to adjust a compressor loading of the compressor assembly 21, such as adjusting fuel output to the combustion section 26, adjusting variable vane angle at the compressor assembly 21 (e.g., at an inlet guide vane, variable stator vane, etc.), adjusting bleed air (e.g., via ports, valves, manifolds, pipes, doors, etc. at a bleed air assembly) from the compressor assembly 21 and/or combustion section 26, or adjusting loading at the mechanical load device or electric machine 92 and rotor assembly 90 coupled together, or adjusting area of the jet exhaust nozzle 32, etc.

As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits. Additionally, the memory 214 can generally include memory element(s) including, but not limited to, computer readable medium (e.g., random access memory (RAM)), computer readable non-volatile medium (e.g., flash memory), a compact disc-read only memory (CD-ROM), a magneto-optical disk (MOD), a digital versatile disc (DVD) and/or other suitable memory elements or combinations thereof. In various embodiments, the controller 210 may define one or more of a full authority digital engine controller (FADEC), a propeller control unit (PCU), an engine control unit (ECU), or an electronic engine control (EEC).

As shown, the controller 210 may include control logic 216 stored in memory 214, such as shown and described in regard to the system 400 (FIG. 5), or particularly the control logic 425 and/or control system 430. The control logic 216 may include instructions that when executed by the one or more processors 212 cause the one or more processors 212 to perform operations, such as steps of the method 1000 for operating a compressor assembly. In still various embodiments, the memory 214 may store graphs or corresponding charts, tables, functions, look ups, etc. based thereon, such as described herein.

Additionally, as shown in FIG. 1, the controller 210 may also include a communications interface module 230. In various embodiments, the communications interface module 230 can include associated electronic circuitry that is used to send and receive data. As such, the communications interface module 230 of the controller 210 can be used to receive data from one or more sensors 410 at the engine 10, such as, but not limited to, rotational speed at the compressor assembly 21, a rate of acceleration or deceleration, a change in rate of acceleration or deceleration, compressor loading, upstream and downstream compressor assembly pressure, inter-stage compressor assembly pressure, vibrations at the compressor assembly, temperature, pressure, and/or flow rate of fluid through the compressor assembly, temperature, pressure and/or flow rate of fuel to the combustion section 26, etc.

In addition, the communications interface module 230 can also be used to communicate with any other suitable components of the engine 10, the compressor assembly 21, and/or system 400, such as to receive data or send commands to/from any number of sensors, valves, vane assemblies, fuel systems, rotor assemblies, ports, etc. controlling speed, acceleration, temperature, pressure, or flow rate at the engine 10.

It should be appreciated that the communications interface module 230 can be any combination of suitable wired and/or wireless communications interfaces and, thus, can be communicatively coupled to one or more components of the engine 10 via a wired and/or wireless connection. As such, the controller 210 may obtain, determine, store, generate, transmit, or operate any one or more steps of the method 1000 at the compressor assembly 21, the engine 10, an apparatus to which the engine 10 is attached (e.g., an aircraft), or a ground, air, or satellite-based apparatus in communication with the engine 10 (e.g., a distributed network).

In various embodiments, the sensors 410 at the engine 10 are positioned proximate to a blade tip 27 at a casing surrounding the compressor assembly 21 such as described herein. For example, the sensor 410 may include a pressure sensor or flow sensor positioned upstream and/or downstream of a rotating stage at the compressor assembly. As another example, the sensor 410 may be positioned proximate to or corresponding to one or more of a leading edge 23 or a trailing edge 25 of a blade of the compressor assembly 21.

Referring now to FIGS. 2-4, flowcharts outlining exemplary steps of the method 1000 for operating a compressor assembly and turbo machine are provided. The method 1000 may improve compressor operability, performance, efficiency, and/or durability by more effectively determining, identifying, or classifying precursors to certain stall or surge conditions. In various embodiments, the determined stall precursor is used to generate one or more control signals or control responses for operating the compressor assembly and turbo machine to avoid or mitigate stall or surge. As further described herein, embodiments of the method 1000 may be implemented as instructions stored in and executed by controllers for turbo machines (e.g., controller 210) or other computer-implemented systems (e.g., system 400).

The method 1000 includes at 1005 initializing operation of the compressor assembly (i.e., rotating and pressurizing the compressor assembly) such as to at 1010 obtain a first data set over a first period of time and at 1020 obtain a second data set over a second period of time after the first period of time. The second data set refers to a subsequent data set relative to the first data set. The second data set is taken at least an integral or complete rotation subsequent to (e.g., after) one or more rotations over which the first data set is taken. Additionally, or alternatively, the first data set refers to some or all data sets preceding the second data set. For example, the first data set may include discrete data points, averages, running averages, etc. corresponding to one or more rotations of the compressor assembly over the first period of time preceding the one or more rotations over the second period of time. As another example, the first data set may include discrete data points, averages, or running averages, etc. of a plurality of data points (e.g., circumferential arrangement of sensors and/or axially arranged sensors across adjacent blade rows at the compressor section, etc.) from a plurality of sensors relative to a revolution of compressor blades. As such, in various embodiments, the first data set corresponds to one or more revolutions of the blades of the compressor assembly preceding one or more revolutions over which the second data set is obtained.

Similarly, the second data set may include discrete data points, averages, running averages, etc. corresponding to a plurality of data points from a plurality of sensors relative to one or more rotations of the compressor assembly subsequent to the first period of time.

In various embodiments, obtaining the first data set and the second data set includes obtaining data corresponding to one or more performance parameters of a fluid through the compressor assembly. In various embodiments, the fluid includes an oxidizer, such as air, flowing through a primary flowpath of the compressor assembly. In certain embodiments, the performance parameter includes a dynamic pressure measurement, a static pressure measurement, a fluid flow rate or velocity measurement, or changes thereof between one or more subsequent revolutions of the compressor assembly, or rates of change thereof between one or more subsequent revolutions of the compressor assembly, or combinations thereof.

Figure 5:
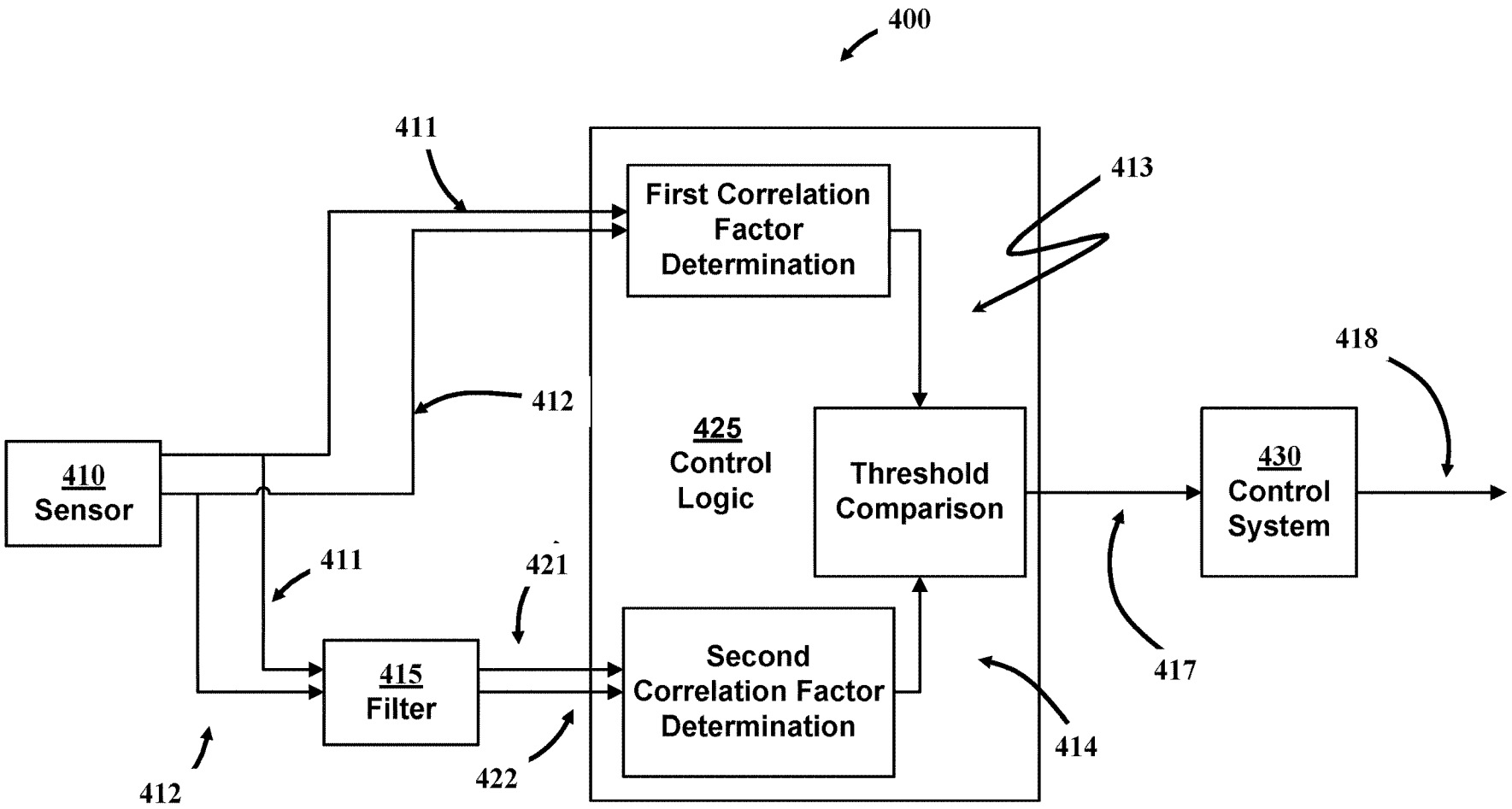
FIG. 5 is a schematic of an exemplary system for operating a compressor assembly.

Referring now to FIG. 5, a schematic flowchart depicting a computer-implemented system 400 (hereinafter, "system 400") is provided. The system 400 is configured to perform one or more steps of the method 1000 such as outlined in FIGS. 2-4. In various embodiments, the system 400 includes a sensor 410 configured to measure, receive, calculate, or otherwise obtain a first data set 411 and a second data set 412 from a compressor assembly. In various embodiments, the first data set 411 and the second data set 412 are direct coupling (DC) signals received from the sensor 410. In certain embodiments, the method 1000 includes comparing a non-high pass filtered first data set 411 and second data set 412. Signals from the sensor 410 corresponding to the first data set 411 and the second data set 412, such as received at steps 1010 and 1020, respectively, are each free of filtering or normalization. As such, the signal received from the sensor 410, such as corresponding to the method 1000 at steps 1010 and 1020, are indicative of high frequency and low frequency components of the performance parameter versus time-dependent domain, such as depicted in graph 300 (FIG. 4).

The system 400 receives and compares the first data set 411 and the second data 412 to determine a first correlation factor 413, such as described in regard to the method 1000 at step 1032. If the first correlation factor crosses, intersects, or otherwise exceeds a first threshold then a stall precursor exists. However, if the first correlation factor does not exceed the first threshold, a stall precursor is not present. The compressor assembly may continue to operate and the system 400 may continue to receive and compare the first data set 411 and the second data set 412 until the first threshold is exceeded, indicating that the stall precursor exists.

When the first correlation factor exceeds the first threshold, indicating that a stall precursor exists, the system 400 further filters the first data set 411 and the second data set 412, such as at filter 415. The filter 415 removes mean values from the first data set 411 and the second data set 412, such as provided in the method 1000 at step 1040. The filter 415 may generally define a DC to AC (capacitive coupling) filter or converter, or a high-pass filter. The filter 415 outputs the first data set and the second data set each removed of mean values (filtered first data set 421 and filtered second data set 422, respectively) and a second correlation factor 414 is determined, such as described in regard to the method 1000 at step 1042. The filtered data sets 421, 422 removed of mean values may generally correspond to low frequency signals or low frequency variation. The filtered data sets 421, 422 may further correspond to absolute values of the first and second data sets 411, 412. The second correlation factor 414 may include comparing value magnitudes with respect to sign or relation to other values. As such, it should be appreciated that in various embodiments, the method 1000 at step 1040 may include comparing value magnitudes that include negative values.

The system 400 includes a control logic 425 configured to compare the first correlation factor and the second correlation factor to one or more thresholds such as described in regard to the method 1000 at step 1044. The control logic 425 may further classify the stall precursor as either the spike stall precursor, the modal stall precursor, or the combination stall precursor, such as described in regard to the method 1000 at step 1046.

Figures 6, 7:
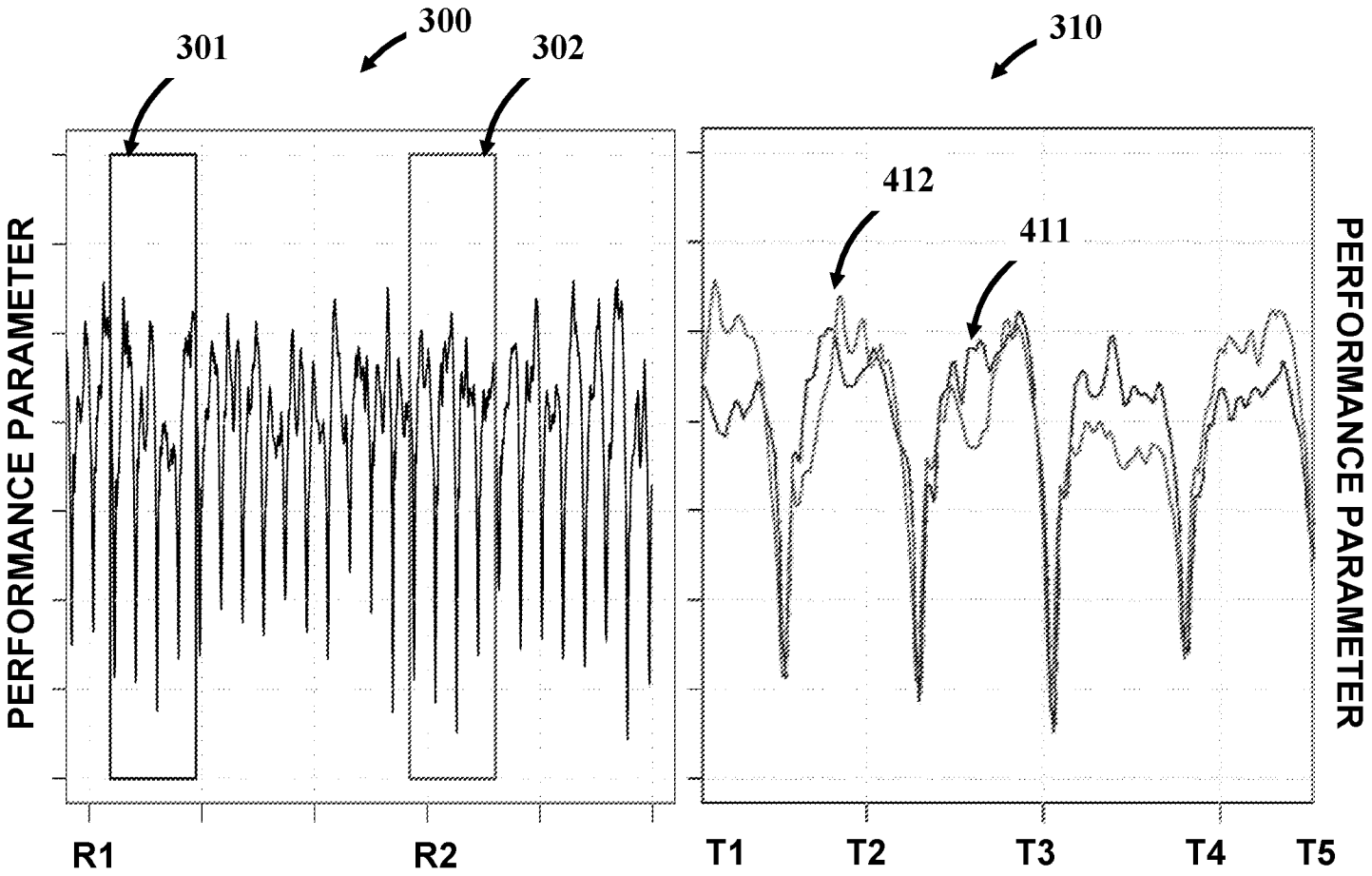
FIG. 6 is an exemplary graph of a performance parameter over time according to an aspect of the present disclosure.
FIG. 7 is an exemplary graph of a performance parameter over time according to an aspect of the present disclosure.

Referring to FIG. 6, an exemplary graph 300 of the performance parameter over a time-dependent domain is provided. In the embodiment depicted in FIG. 6, the time-dependent domain is revolutions of a rotating stage of blades of a compressor assembly during operation. R2 defines one or more subsequent integral revolutions of the compressor assembly after R1. In various embodiments, the graph 300 depicts a performance parameter at a circumferential location of the compressor assembly corresponding to a rotating stage of blades. It should be appreciated that in other exemplary embodiments, the graph 300 may include a plurality of performance parameters corresponding to different circumferential locations at the rotating stage of blades. In still other embodiments, the graph 300 may compare a plurality of rotating stages.

Referring to FIG. 6, area 301 represents a first period of time over which a first data set is obtained, such as described in regard to step 1010 of the method 1000. Area 302 represents a second period of time over which a second data set is obtained, such as described in regard to step 1020 of the method 1000. Referring to FIG. 7, exemplary graph 310 depicts an overlay comparison of the first data set (depicted at 411) obtained at the first period of time (e.g., depicted at area 301 in FIG. 6) and the second data set (depicted at 412) obtained at the second period of time (e.g., depicted at area 302 in FIG. 6).

In various embodiments, obtaining the first and second data sets includes obtaining data at or near the blade tip at one or more axially adjacent blade rows of the compressor assembly. In another embodiment, obtaining data at the blade tip may include obtaining performance parameter measurements corresponding to a leading edge, a trailing edge, or a span therebetween, of the blade. In yet another embodiment, obtaining data at the blade tip may include positioning a sensor at or near a vane, stator, or casing immediately upstream or downstream, or both, of the rotating blade row. In still other embodiments, obtaining data may include a measurement from a sensor positioned at the rotating blade itself, such as via an electromechanical device configured to transmit power and electrical signals between static and rotary structures (e.g., a slip ring, a telemetry device, transmitter, etc.).

In still various embodiments, the method 1000 includes at 1007 measuring the performance parameter of the fluid at the compressor assembly, in which measuring the performance parameter generates a first data set and a second data set during a revolution of the compressor assembly after obtaining the first data set. In certain embodiments, measuring the performance parameter of the fluid includes measuring one or more of dynamic pressure, static pressure, flow rate, or velocity, or changes thereof between one or more subsequent revolutions of the compressor assembly, or rates of changes thereof between one or more subsequent revolutions of the compressor assembly, or combinations thereof.

Referring back to FIGS. 2-4, various embodiments of the method 1000 further includes at 1030 comparing the first data set and the second data set to determine a first correlation factor. The first correlation factor represents a degree by which the first data set and the second data set match one another. In various embodiments, the first correlation factor includes a signal matching algorithm or a cross-correlation function to process time-dependent signals. The time dependent signals may be based at least on the first data set and the second data set at one or more revolutions of the compressor assembly after or subsequent to the revolution(s) at which the first data set is obtained. The first correlation factor may be normalized to a scale of zero to one, or −1 to 1, or another appropriate scale.

The method 1000 further includes at 1032 comparing the first correlation factor to a first threshold. The first threshold at least partially determines whether a stall precursor exists. The first correlation factor equaling or exceeding the first threshold is indicative of a stall precursor existing at the compressor assembly. It should be appreciated that in various embodiments the first threshold may be a user input. The first threshold may be based at least on a known or desired limit relative to stall propagation at the compressor assembly.

The method 1000 at 1030 and 1032 determines whether a stall precursor exists during operation of the compressor assembly. Stall precursor includes the spike stall precursor, the modal stall precursor, or the combination stall precursor including the spike stall precursor and the modal stall precursor. At 1040, the method 1000 further includes removing or filtering mean values from the first data set and the second data set obtained at steps 1010 and 1020, respectively. At 1042, the method 1000 includes comparing the first data set and the second data set each removed of mean values (i.e., the first data set and the second data set obtained from step 1040) to determine a second correlation factor different from the first correlation factor. At 1044, the method 1000 includes comparing the second correlation factor to the first threshold. Comparing the second correlation factor to the first threshold at least partially determines whether the stall precursor determined at step 1030 is either the spike stall precursor, the modal stall precursor, or the combination stall precursor. The method 1000 at 1046 further classifies the stall precursor as either the spike stall precursor, the modal stall precursor, or the combination stall precursor based at least on comparing the second correlation factor to the first threshold.

In certain embodiments, the stall precursor is classified at step 1046 as the spike stall precursor if the first correlation factor exceeds the first threshold and the second correlation factor exceeds the first threshold. In still certain embodiments, the stall precursor is classified in step 1046 as the modal stall precursor if the first correlation factor exceeds the first threshold and the second correlation factor does not exceed the first threshold.

Figure 8:
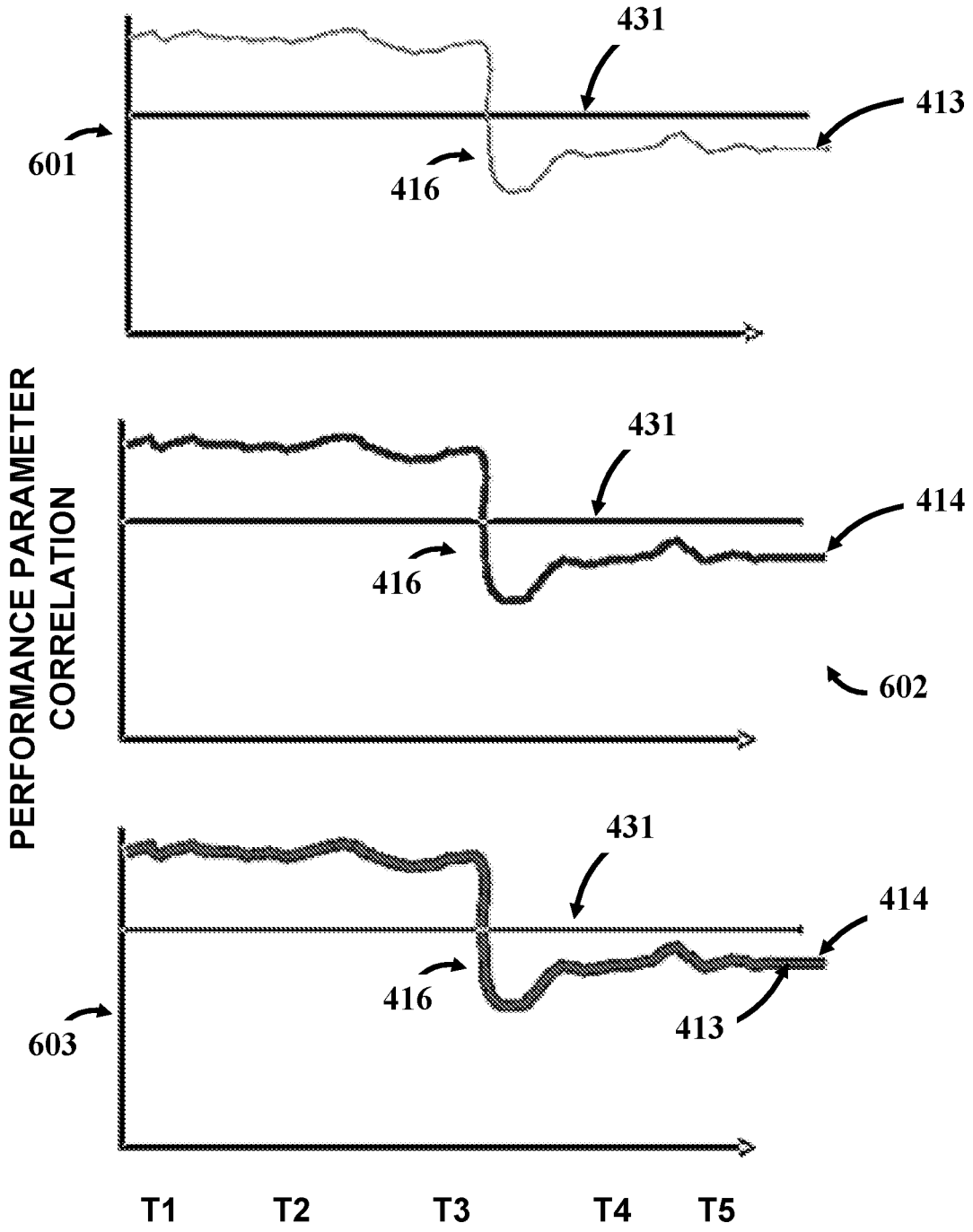
FIG. 8 includes exemplary graphs depicting comparisons of correlation factors to thresholds according to an aspect of the present disclosure.
Figure 9:
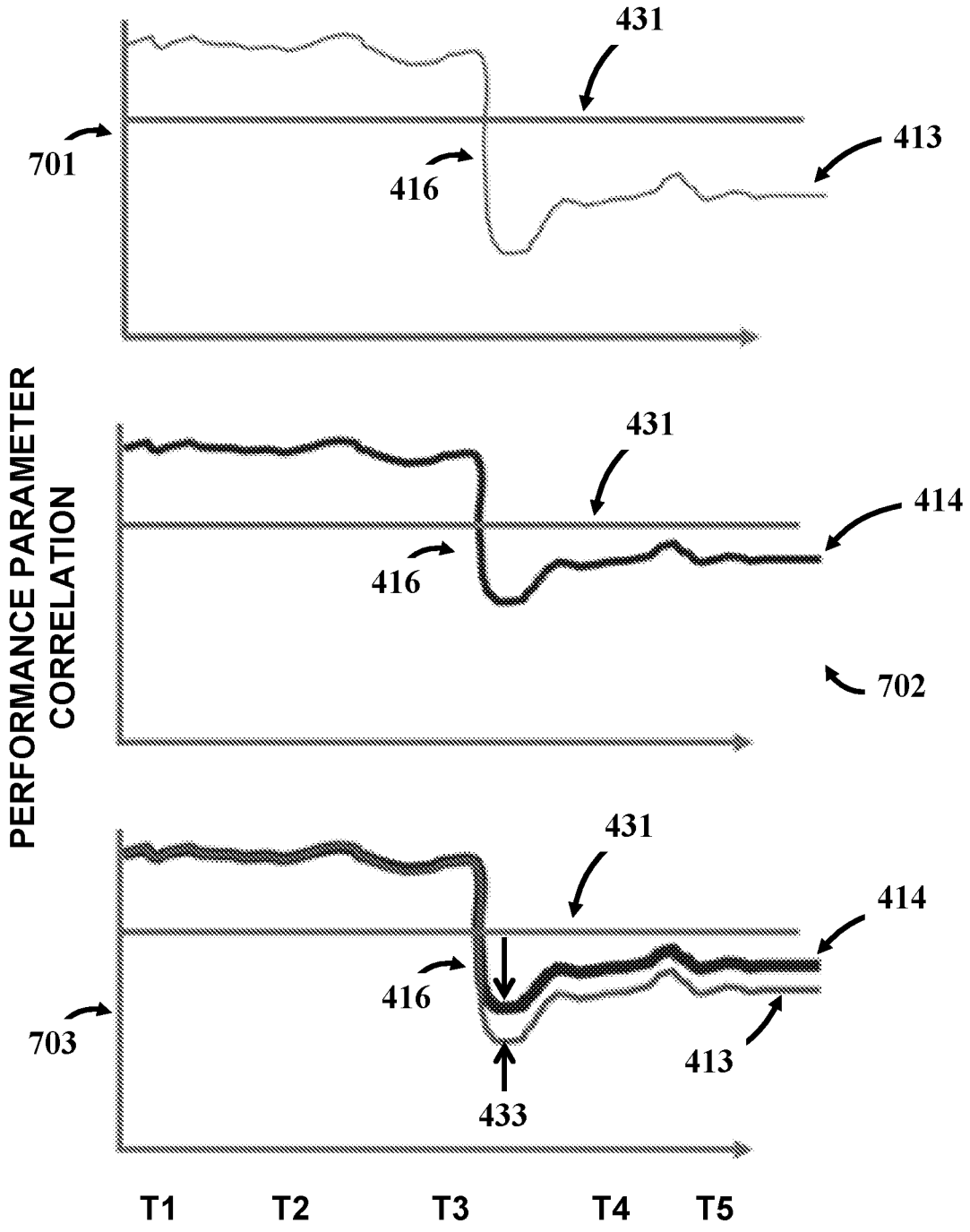
FIG. 9 includes exemplary graphs depicting comparisons of correlation factors to thresholds according to an aspect of the present disclosure.
Figure 10:
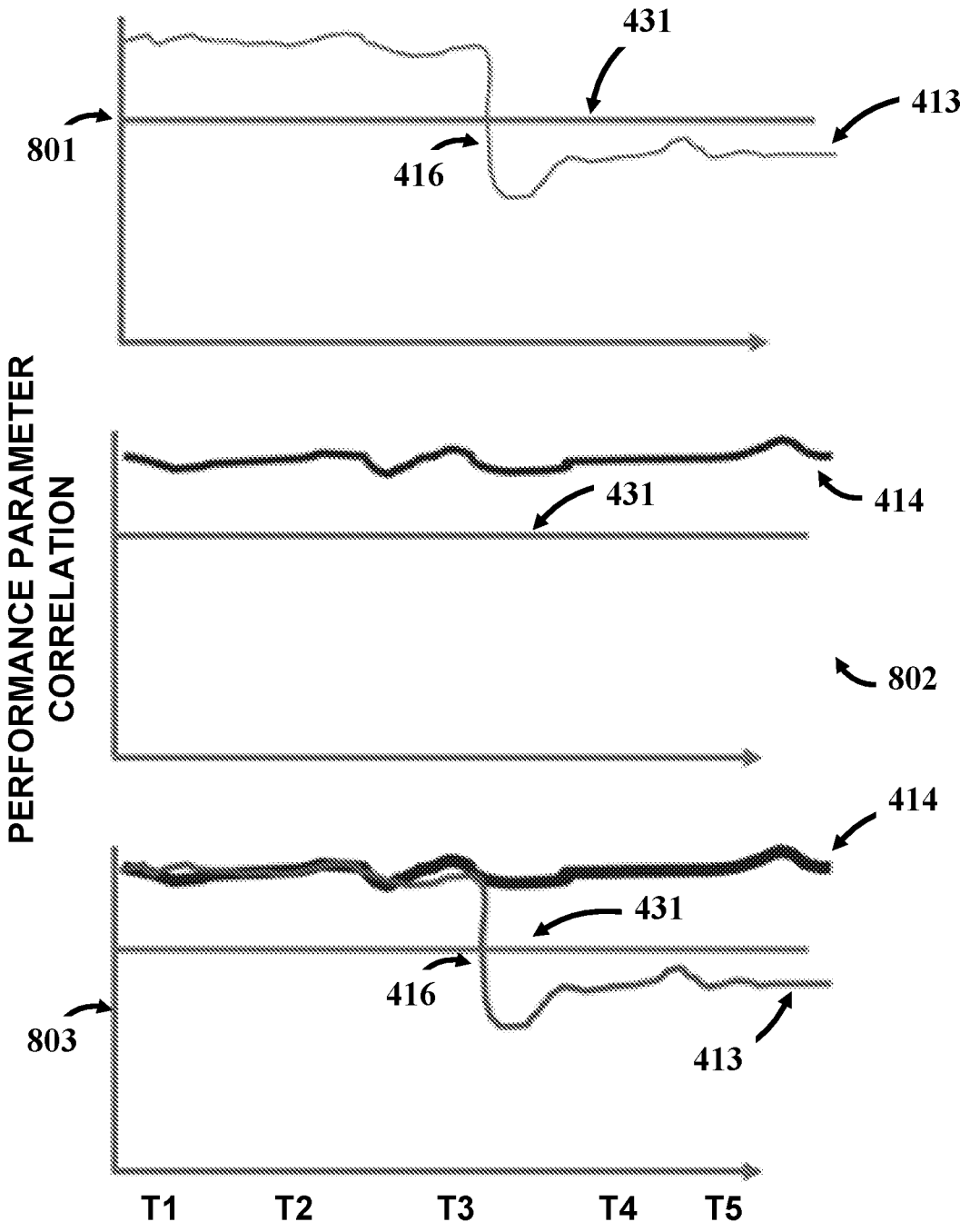
FIG. 10 includes exemplary graphs depicting comparisons of correlation factors to thresholds according to an aspect of the present disclosure.

Referring now to FIG. 8, FIG. 9, and FIG. 10, exemplary graphs are provided depicting steps of the method 1000 as may be performed by the system 400. FIGS. 8-10 depict graphs of a performance parameter correlation versus time-dependent domain (e.g., pressure comparison versus time). It should be appreciated that the time-dependent domain depicted in FIG. 7 and FIGS. 8-10 may represent instants of time. Each of graphs 601, 701, and 801 depict a performance parameter correlation, such as the first correlation factor 413 determined from a comparison of the first data set 411 and the second data set 412 (FIG. 7, FIG. 5), and then compared to a first threshold 431, such as described in regard to method 1000 at step 1032. In each of graphs 601, 701, and 801, the first correlation factor 413 exceeds the first threshold 431 (e.g., crosses the first threshold 431). In each of graphs 602, 702, and 802 a performance parameter correlation comparison of the second correlation factor 414 to the first threshold 431 is provided, such as described in regard to the method 1000 at step 1044. In regard to graph 602 and graph 702 depicted in FIGS. 8-9, respectively, the second correlation factor 414 exceeds the first threshold 431. In contrast, graph 802 in FIG. 10 depicts the second correlation factor 414 not exceeding the first threshold 431. In instances such as depicted in graph 802, the control logic 425 classifies the stall precursor as the modal stall precursor indicative of the compressor assembly operating toward a modal stall condition.

Referring further to graphs 603, 703, and 803 in FIGS. 8-10, respectively, overlays of the comparison of the first threshold 431 to each of the first correlation factor 413 and the second correlation factor 414 from graphs 601, 602, 701, 702, 801, and 802 are provided respectively at graphs 603, 703, and 803. In various embodiments, the method 1000 and the system 400 compares magnitudes of the first correlation factor 413 and the second correlation factor 414 to further determine whether the stall precursor 416 is a spike stall precursor or a combination stall precursor. When the first correlation factor 413 and the second correlation factor 414 are substantially similar in magnitude, such as depicted in regard to graph 603, the stall precursor is classified or identified as the spike stall precursor.

In contrast, when the first correlation factor 413 and the second correlation factor 414 differ in magnitude, such as depicted in regard to graph 703, the stall precursor is classified or identified as the combination stall precursor. In various embodiments, the method 1000 includes at 1050 comparing the second correlation factor to a magnitude threshold, in which the magnitude threshold (e.g., magnitude threshold 433 in graph 703 in FIG. 9) indicates whether the stall precursor is the combination stall precursor or the spike stall precursor. Referring to graph 703 in FIG. 9, a magnitude threshold 433 includes a magnitude difference in performance parameter correlation between the first correlation factor 413 and the second correlation factor 414. In certain embodiments, the magnitude threshold 433 compares the first correlation factor 413 and the second correlation factor 414 at a time subsequent to the stall precursor 416.

In still various embodiments, the method 1000 includes at 1046 classifying the stall precursor as one of either the combination stall precursor or the spike stall precursor based at least on the magnitude threshold 433. The stall precursor is the combination stall precursor if the second correlation factor equals or exceeds the first threshold and the magnitude threshold (e.g., depicted in FIG. 9). The stall precursor is classified as the spike stall precursor if the second correlation factor does not exceed magnitude threshold (e.g., depicted in FIG. 8).

In various embodiments, a minimal degree of similarity, or alternatively, a maximal degree of dissimilarity (e.g., at or approaching 0 on a range of 0 to 1, or at or approach −1 on a range of −1 to 1, etc.) between the first correlation factor 413 and the second correlation factor 414 indicates a presence of both modal stall precursors and spike stall precursors such as to indicate the combination stall precursor classification (such as depicted in FIG. 9 at graph 703) in contrast to the spike stall precursor classification (such as depicted in FIG. 8 at graph 603). The magnitude threshold 433 may be indicative of a range at or over which the first correlation factor 413 and the second correlation factor 414 are dissimilar, although both the first correlation factor 413 and the second correlation factor 414 exceed the first threshold 431. In FIG. 10, in contrast to FIGS. 8-9, although the first correlation factor 413 and the second correlation factor 414 are each dissimilar, only the first correlation factor 413 exceeds the first threshold 431. As such, graph 803 in FIG. 10 indicates the presence of only the modal stall precursor.

Differences between the spike stall precursor and the modal stall precursor may correspond to whether stall or surge conditions at the compressor assembly are developing at a blade tip or at a blade root or hub. Whether the stall or surge conditions are developing at the blade tip or at the blade root or hub further correspond to how an operating mode (e.g., rotational speed, acceleration, rate of acceleration, air and/or fuel flow rate, etc.) of the turbo machine may be adjusted to mitigate stall or surge at the compressor assembly.

In still various embodiments, the two or more steps of the method 1000 are in sequential order such as to determine whether the compressor assembly is operating with a stall precursor condition, and then to determine whether the stall precursor condition is specifically either the spike stall precursor, the modal stall precursor, or the combination spike and modal stall precursor. In one embodiment, the method 1000 at 1030 immediately precedes the step 1032. In another embodiment, the method 1000 at 1040 immediately precedes the method 1000 at steps 1042, 1044, and 1046.

In various embodiments, the magnitude threshold 433 may be based at least on a known or desired limit relative to stall propagation at the compressor assembly. In one embodiment, the magnitude threshold 433 defines an approximately 33% or less difference in magnitude between the first correlation factor 413 and the second correlation factor 414. In another embodiment, the magnitude threshold 433 defines an approximately 25% difference in magnitude between the first correlation factor 413 and the second correlation factor 414. In yet another embodiment, the magnitude threshold 433 defines an approximately 20% difference in magnitude between the first correlation factor 413 and the second correlation factor 414. In still another embodiment, the magnitude threshold 433 defines an approximately 10% difference in magnitude between the first correlation factor 413 and the second correlation factor 414. In still yet another embodiment, the magnitude threshold 433 defines an approximately 5% or greater difference in magnitude between the first correlation factor 413 and the second correlation factor 414. In various embodiments, the first correlation factor 413 and the second correlation factor 414 are substantially equal in magnitude if the magnitude difference is less than approximately 5%.

It should be appreciated that embodiments of the method 1000 implemented at a turbo machine, or in various embodiments of the system 400 or controller 210 shown and described herein, one or more of the first threshold, the second threshold, and/or the magnitude threshold described herein may vary based at least on an apparatus or desired operating condition of the turbo machine. For example, thresholds, or magnitudes thereof, associated with a fan assembly, a low pressure (LP) compressor, an intermediate pressure (IP) compressor, or a high pressure (HP) compressor may vary substantially relative to one another. Additionally, or alternatively, thresholds, or magnitudes thereof, may vary substantially across stages of compression within one of the fan assembly, the LP compressor, the IP compressor, or the HP compressor. It should therefore be appreciated that the threshold, or magnitudes thereof, may vary based at least on a desired airflow rate, pressure, pressure ratio, temperature, quantity of stages or compression, rate and/or percentage of bleed airflow, rate and/or percentage of bypass airflow, or other airflow control mechanism.

Referring back to FIG. 5, various embodiments of the system 400 further outputs 417 from the control logic 425 the classification of the stall precursor as either the spike stall precursor, the modal stall precursor, or the combination stall precursor. A control system 430 receives the output signal 417 from the control logic 425.

Referring back to FIGS. 2-4, in various embodiments the method 1000 may further include at 1060 generating a control signal based on whether the stall precursor is classified as one of the spike stall precursor, the modal stall precursor, or the combination stall precursor. In certain embodiments, generating the control signal at 1060 includes adjusting a desired performance parameter at the turbo machine based at least on the identified or classified type of stall precursor. Referring to FIG. 5, the control system 430 may generate and output a control signal 418 to a controller configured to operate one or more of a desired compressor loading separate, different, or unique from one another. The changes in compressor loading include, but is not limited to, changes in fuel output to the combustion section (e.g., changes in fuel flow or pressure), changes in variable vane angle (e.g., at an inlet guide vane, variable stator vane, etc.), or changes in bleed air (e.g., at an upstream compressor bleed, at one or more inter-stage compressor bleeds, at a downstream bleed, such as at the combustion section, at a variable vane door at or between one or more compressors 22, 24 in FIG. 1, etc.), varying a $3^{rd}$ stream air flow path, or varying an exhaust nozzle area, etc. In still various embodiments, the rotor assembly to which the compressor assembly is attached may further include a mechanical load device or an electric machine configured to adjust loading applied to the compressor assembly, such as to provide changes in rate of acceleration of the compressor assembly.

In certain embodiments, the method 1000 further includes adjusting a performance parameter at the compressor assembly based at least on the control signal generated at 1060. Adjusting the performance parameter is based at least on the stall precursor being classified as one of the spike stall precursor, the modal stall precursor, or the combination stall precursor, such as described in regard to step 1046.

Adjusting the performance parameter may be based at least on a control response generated based on the control signal. In various embodiments, the method 1000 includes at 1062 generating a first control response based at least on stall or surge conditions developing at the blade tip, such as corresponding to the stall precursor classified as the spike stall precursor. In another embodiment, the method 1000 at 1060 further includes at 1064 generating a second control response based at least on stall or surge conditions developing at the blade root or hub, such as corresponding to the modal stall precursor. In still another embodiment, the method 1000 includes at 1066 generating a third control response based at least on stall or surge conditions developing at both of the blade tip and the blade root or hub, such as corresponding to both of the spike stall precursor and the modal stall precursor (i.e., the combination stall precursor).

In various embodiments, the method 1000 further includes at 1070 operating the turbo machine based at least on the generated control signal at 1060, and/or one or more of the control responses at 1062, 1064, or 1066. In still various embodiments, such as described above, the method 1000 at 1070 includes at 1072 adjusting a compressor loading at the compressor assembly.

Referring back to FIG. 4, in certain embodiments, the method 1000 further includes at 1072 adjusting a compressor loading at the compressor assembly based at least on a classification of the stall precursor as one of the spike stall precursor, the modal stall precursor, or the combination stall precursor, such as described in regard to step 1046. In another embodiment, the method 1000 further includes at 1074 adjusting the performance parameter at the compressor assembly based at least on the classification of the stall precursor such as described in regard to step 1046. In some embodiments, adjusting the compressor loading at 1072 or adjusting the performance parameter includes reducing fuel flow to the combustion section, increasing mechanical load device or electric machine loading onto a rotor assembly including the compressor assembly, or actuating (i.e., opening or closing) one or more bleed valves or ports of a bleed air assembly based at least on the generated control signal (such as described in regard to step 1060) or the generated control response (such as described in regard to step 1062, 1064, or 1066).

Figure 11:
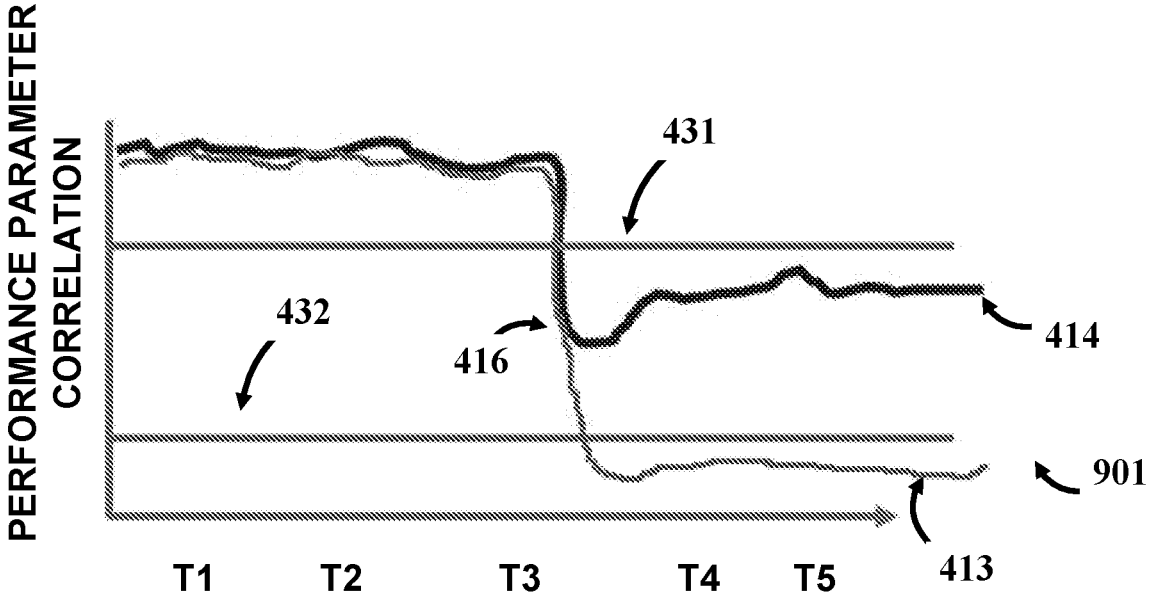
FIG. 11 includes an exemplary graph depicting comparison of correlation factors to thresholds according to an aspect of the present disclosure; and Repeat use of reference characters in the present specification and drawings is intended to represent the same or analogous features or elements of the present invention.

Referring now to FIG. 11, in some embodiments, the method 1000 may include comparing the second correlation factor to a second threshold (e.g., second threshold 432 depicted in FIG. 11) different from the first threshold (e.g., first threshold 431). In certain embodiments, if the first correlation factor 413 crosses the first threshold 431 and the second threshold 432, and the second correlation factor 414 crosses the first threshold 431 but does not cross the second threshold 432, the stall precursor is classified at step 1046 as the combination stall precursor, such as depicted in regard to graph 901 in FIG. 11. If the first correlation factor 413 crosses the first threshold 431 and the second threshold 432, and the second correlation factor 414 crosses both the first threshold 431 and the second threshold 432, the stall precursor is classified as the spike stall precursor. If the first correlation factor crosses the first threshold 431 and the second threshold 432, and the second correlation factor 414 does not cross the first threshold 431 and the second threshold 432, the stall precursor is classified as the modal stall precursor, such as depicted in part in graph 802 in FIG. 10.

It should be appreciated that a difference in magnitude between the first threshold 431 and the second threshold 432 may alternatively be represented by the magnitude threshold 433, such as depicted and described in regard to FIG. 9.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the invention are provided by the subject matter of the following clauses:

1. A computer-implemented method for operating a compressor assembly, the method comprising obtaining a first data set over a first period of time, obtaining a second data set over a second period of time after the first period of time, comparing the first data set and the second data set to determine a first correlation factor, comparing the first correlation factor to a first threshold, wherein the first threshold at least partially determines whether a stall precursor exists, removing mean values from the first data set and the second data set, comparing the first data set and the second data set each removed of mean values to determine a second correlation factor, comparing the second correlation factor to the first threshold, wherein comparing the second correlation factor to the first threshold at least partially determines whether the stall precursor comprises one of a spike stall precursor, a modal stall precursor, or a combination stall precursor, and classifying the stall precursor as either the spike stall precursor, the modal stall precursor, or the combination stall precursor.

2. The computer-implemented method of any preceding clause, wherein the stall precursor is classified as one of the spike stall precursor or the combination stall precursor if the first correlation factor exceeds the first threshold and the second correlation factor exceeds the first threshold, and wherein the stall precursor is classified as the modal stall precursor if the first correlation factor exceeds the first threshold and the second correlation factor does not exceed the first threshold.

3. The computer-implemented method of any preceding clause, the method including generating a control signal based on whether the stall precursor is classified as one of the spike stall precursor, the modal stall precursor, or the combination precursor.

4. The computer-implemented method of any preceding clause, including adjusting a performance parameter at the compressor assembly based at least on the control signal, wherein adjusting the performance parameter is based at least on the stall precursor being classified as one of the spike stall precursor, the modal stall precursor, or the combination stall precursor.

5. The computer-implemented method of any preceding clause, including comparing the second correlation factor to a magnitude threshold indicative of the stall precursor being classified as either the combination stall precursor or the spike stall precursor.

6. The computer-implemented method of any preceding clause, including classifying the stall precursor as one of either the combination stall precursor or the spike stall precursor, wherein the stall precursor is the combination stall precursor if the second correlation factor exceeds the first threshold and the magnitude threshold, and wherein the stall precursor is the spike stall precursor if the second correlation factor does not exceed magnitude threshold.

7. The computer-implemented method of any preceding clause, wherein removing mean values from the first data set and the second data set comprises converting the first data set and the second data set from a direct current signal to an alternating current signal.

8. The computer-implemented method of any preceding clause, wherein obtaining the second data set over a second period of time is during a revolution of the compressor assembly after obtaining the first data set.

9. A computing system for operating a turbo machine, the computing system configured to perform operations, the operations including the method of any preceding clause.

10. The computing system of any preceding clause, the operations including obtaining a first data set over a first period of time, obtaining a second data set over a second period of time after the first period of time, wherein the second period of time is during a revolution of the turbo machine after obtaining the first data set over the first period of time, identifying whether a stall precursor exists at the turbo machine, identifying a type of stall precursor, wherein the type of stall precursor comprises one of a spike stall precursor, a modal stall precursor, or a combination stall precursor. Identifying the type of stall precursor includes the method of any preceding clause.

11. The computing system of any preceding clause, the operations including comparing the first data set and the second data set to provide a first correlation factor, removing mean values from the first data set and the second data set, determining a second correlation factor by comparing the first data set and the second data set each removed of mean values, and comparing the second correlation factor to a first threshold, and generating a control signal based at least on the identified type of stall precursor.

12. The computing system of any preceding clause, wherein the type of stall precursor is identified as the modal stall precursor if the first correlation factor exceeds the first threshold and the second correlation factor does not exceed the first threshold.

13. The computing system of any preceding clause, wherein the type of stall precursor is identified as one of the spike stall precursor or the combination stall precursor if the first correlation factor exceeds the first threshold and the second correlation factor exceeds the first threshold.

14. The computing system of any preceding clause, wherein the type of stall precursor is identified as the combination stall precursor if the second correlation factor exceeds the first threshold and a magnitude threshold, wherein the magnitude threshold is a predetermined difference in magnitude between the first correlation factor and the second correlation factor.

15. The computing system of any preceding clause, the operations including generating a first control response based at least on the control signal, wherein the first control response corresponds to the spike stall precursor, and wherein the spike stall precursor is indicative of a stall condition or a surge condition at the turbo machine.

16. The computing system of any preceding clause, the operations including generating a second control response based at least on the control signal, wherein the second control response corresponds to the modal stall precursor.

17. The computing system of any preceding clause, the operations including comparing the second correlation factor to a second threshold different from the first threshold, wherein the type of stall precursor is identified as the combination stall precursor if the first correlation factor exceeds the first threshold and the second correlation factor does not exceed the second threshold, wherein the type of stall precursor is identified as the spike stall precursor if the first correlation factor exceeds the first threshold and the second correlation factor exceeds the second threshold, and wherein the type of stall precursor is identified as the modal stall precursor if the second correlation factor does not exceed the first threshold.

18. A turbo machine including the computing system of any preceding clause.

19. A turbo machine configured to execute the computer-implemented method of any preceding clause.

20. A turbo machine of any preceding clause, the turbo machine including a compressor assembly, wherein the compressor assembly includes a sensor positioned at adjacent stages of compressor blade rows, wherein the sensor is configured to obtain a performance parameter of a fluid through the compressor assembly.

21. The turbo machine of any preceding clause, the turbo machine including a controller including a processor and memory configured to store instructions that, when executed by the processor, causes the processor to perform operations, the operations including the operations of the computer system of any preceding clause and/or the steps of the method of any preceding clause.

22. The turbo machine of any preceding clause, the operations including obtaining, via the sensor, a first data set over a first period of time during rotation of the compressor assembly, and obtaining, via the sensor, a second data set over a second period of time following the first period of time, wherein the second period of time corresponds to one or more revolutions of the compressor assembly after the first period of time.

23. The turbo machine of any preceding clause, the operations including comparing the first data set and the second data set to determine a first correlation factor, removing mean values of the first data set and the second data set, determining a second correlation factor by comparing the first data set and the second data set each removed of mean values, and determining a type of stall precursor at the compressor assembly, wherein determining the type of stall precursor is based at least on comparing the first correlation factor to a first threshold and comparing the second correlation factor to a magnitude threshold, and wherein the type of stall precursor is one of a spike stall precursor, a modal stall precursor, or a combination stall precursor, and operating the compressor assembly based at least on the determined type of stall precursor.

24. The turbo machine of any preceding clause, the operations including adjusting the performance parameter at the compressor assembly based at least on the stall precursor being one of the spike stall precursor, the modal stall precursor, or the combination stall precursor.

25. The turbo machine of any preceding clause, the operations including generating a control signal based at least on the type of stall precursor determined at the compressor assembly, wherein operating the compressor assembly is based at least on the generated control signal.

26. The turbo machine of any preceding clause, the operations including measuring the performance parameter of the fluid at the compressor assembly, wherein measuring the performance parameter generates the first data set and the second data set.

27. The turbo machine of any preceding clause, wherein measuring the performance parameter of the fluid comprises measuring one or more of dynamic pressure, static pressure, flow rate, or velocity, or changes thereof between one or more subsequent revolutions of the compressor assembly, or rates of changes thereof between one or more subsequent revolutions of the compressor assembly, or combinations thereof.

28. The turbo machine of any preceding clause, the controller including a communications interface module configured to receive data from the sensor, the data including rotational speed at the compressor assembly, a rate of acceleration or deceleration at the compressor assembly, a change in rate of acceleration or deceleration at the compressor assembly, compressor loading, upstream and downstream compressor assembly pressure, inter-stage compressor assembly pressure, vibrations at the compressor assembly, temperature, pressure, and/or flow rate of fluid through the compressor assembly, temperature, pressure and/or flow rate of fuel to a combustion section, or combinations thereof.

29. The turbo machine of any preceding clause, the communications interface module configured to receive data and/or send commands to/from a valve, a vane assembly, a fuel system, a rotor assembly, and/or a port at a compressor assembly configured to control one or more of speed, acceleration, temperature, pressure, or flow rate of fluid through the compressor assembly and/or fuel at the combustion section.

30. The turbo machine of any preceding clause, the controller including a control logic including instructions that when executed by the processor causes the processor to perform operations of any preceding clause.

31. The computing system of any preceding clause, the computing system configured to perform operations of any preceding clause.

32. The computer implemented method of any preceding clause, the method including operations of any preceding clause.

What is claimed is:

1. A computer-implemented method for operating a compressor assembly, the method comprising:

obtaining a first data set over a first period of time;

obtaining a second data set over a second period of time after the first period of time;

comparing the first data set and the second data set to determine a first correlation factor;

comparing the first correlation factor to a first threshold, wherein the first threshold at least partially determines whether a stall precursor exists;

removing mean values from the first data set and the second data set;

comparing the first data set and the second data set each removed of mean values to determine a second correlation factor;

comparing the second correlation factor to the first threshold, wherein comparing the second correlation factor to the first threshold at least partially determines whether the stall precursor comprises one of a spike stall precursor, a modal stall precursor, or a combination stall precursor; and classifying the stall precursor as either the spike stall precursor, the modal stall precursor, or the combination stall precursor.

2. The computer-implemented method of claim 1, wherein the stall precursor is classified as one of the spike stall precursor or the combination stall precursor if the first correlation factor exceeds the first threshold and the second correlation factor exceeds the first threshold, and wherein the stall precursor is classified as the modal stall precursor if the first correlation factor exceeds the first threshold and the second correlation factor does not exceed the first threshold.

3. The computer-implemented method of claim 2, comprising:

generating a control signal based on whether the stall precursor is classified as one of the spike stall precursor, the modal stall precursor, or the combination precursor.

4. The computer-implemented method of claim 3, comprising:

adjusting a performance parameter at the compressor assembly based at least on the control signal, wherein adjusting the performance parameter is based at least on the stall precursor being classified as one of the spike stall precursor, the modal stall precursor, or the combination stall precursor.

5. The computer-implemented method of claim 2, comprising:

comparing the second correlation factor to a magnitude threshold indicative of the stall precursor being classified as either the combination stall precursor or the spike stall precursor.

6. The computer-implemented method of claim 5, comprising:

classifying the stall precursor as one of either the combination stall precursor or the spike stall precursor, wherein the stall precursor is the combination stall precursor if the second correlation factor exceeds the first threshold and the magnitude threshold, and wherein the stall precursor is the spike stall precursor if the second correlation factor does not exceed magnitude threshold.

7. The computer-implemented method of claim 1, wherein removing mean values from the first data set and the second data set comprises converting the first data set and the second data set from a direct current signal to an alternating current signal.

8. The computer-implemented method of claim 1, wherein obtaining the second data set over a second period of time is during a revolution of the compressor assembly after obtaining the first data set.

9. A computing system for operating a turbo machine, the computing system configured to perform operations, the operations comprising:

obtaining a first data set over a first period of time;

obtaining a second data set over a second period of time after the first period of time, wherein the second period of time is during a revolution of the turbo machine after obtaining the first data set over the first period of time;

identifying whether a stall precursor exists at the turbo machine;

identifying a type of stall precursor, wherein the type of stall precursor comprises one of a spike stall precursor, a modal stall precursor, or a combination stall precursor, and wherein identifying the type of stall precursor comprises:

comparing the first data set and the second data set to provide a first correlation factor;

removing mean values from the first data set and the second data set;

determining a second correlation factor by comparing the first data set and the second data set each removed of mean values; and comparing the second correlation factor to a first threshold; and generating a control signal based at least on the identified type of stall precursor.

10. The computing system of claim 9, wherein the type of stall precursor is identified as the modal stall precursor if the first correlation factor exceeds the first threshold and the second correlation factor does not exceed the first threshold.

11. The computing system of claim 9, wherein the type of stall precursor is identified as one of the spike stall precursor or the combination stall precursor if the first correlation factor exceeds the first threshold and the second correlation factor exceeds the first threshold.

12. The computing system of claim 11, wherein the type of stall precursor is identified as the combination stall precursor if the second correlation factor exceeds the first threshold and a magnitude threshold, wherein the magnitude threshold is a predetermined difference in magnitude between the first correlation factor and the second correlation factor.

13. The computing system of claim 9, the operations comprising:

generating a first control response based at least on the control signal, wherein the first control response corresponds to the spike stall precursor, and wherein the spike stall precursor is indicative of a stall condition or a surge condition at the turbo machine.

14. The computing system of claim 9, the operations comprising:

generating a second control response based at least on the control signal, wherein the second control response corresponds to the modal stall precursor.

15. The computing system of claim 9, the operations comprising:

comparing the second correlation factor to a second threshold different from the first threshold, wherein the type of stall precursor is identified as the combination stall precursor if the first correlation factor exceeds the first threshold and the second correlation factor does not exceed the second threshold, wherein the type of stall precursor is identified as the spike stall precursor if the first correlation factor exceeds the first threshold and the second correlation factor exceeds the second threshold, and wherein the type of stall precursor is identified as the modal stall precursor if the second correlation factor does not exceed the first threshold.

16. A turbo machine, the turbo machine comprising:

a compressor assembly, wherein the compressor assembly comprises a sensor positioned at adjacent stages of compressor blade rows, wherein the sensor is configured to obtain a performance parameter of a fluid through the compressor assembly; and a controller comprising a processor and memory configured to store instructions that, when executed by the processor, causes the processor to perform operations, the operations comprising:

obtaining, via the sensor, a first data set over a first period of time during rotation of the compressor assembly;

obtaining, via the sensor, a second data set over a second period of time following the first period of time, wherein the second period of time corresponds to one or more revolutions of the compressor assembly after the first period of time;

comparing the first data set and the second data set to determine a first correlation factor;

removing mean values of the first data set and the second data set;

determining a second correlation factor by comparing the first data set and the second data set each removed of mean values;

determining a type of stall precursor at the compressor assembly, wherein determining the type of stall precursor is based at least on comparing the first correlation factor to a first threshold and comparing the second correlation factor to a magnitude threshold, and wherein the type of stall precursor is one of a spike stall precursor, a modal stall precursor, or a combination stall precursor; and operating the compressor assembly based at least on the determined type of stall precursor.

17. The turbo machine of claim 16, the operations comprising:

adjusting the performance parameter at the compressor assembly based at least on the stall precursor being one of the spike stall precursor, the modal stall precursor, or the combination stall precursor.

18. The turbo machine of claim 16, the operations comprising:

generating a control signal based at least on the type of stall precursor determined at the compressor assembly, wherein operating the compressor assembly is based at least on the generated control signal.

19. The turbo machine of claim 16, the operations comprising:

measuring the performance parameter of the fluid at the compressor assembly, wherein measuring the performance parameter generates the first data set and the second data set.

20. The turbo machine of claim 19, wherein measuring the performance parameter of the fluid comprises measuring one or more of dynamic pressure, static pressure, flow rate, or velocity, or changes thereof between one or more subsequent revolutions of the compressor assembly, or rates of changes thereof between one or more subsequent revolutions of the compressor assembly, or combinations thereof.

* * * * *